US005233929A

United States Patent [19]

Spahn

[11] Patent Number: 5,233,929

[45] Date of Patent: Aug. 10, 1993

[54] BOOSTER EXPLOSIVE RINGS

[75] Inventor: Patrick F. Spahn, Silver Spring, Md.

[73] Assignee: The United States of America as represented by the Secretary of the Navy, Washington, D.C.

[21] Appl. No.: 882,721

[22] Filed: May 14, 1992

[51] Int. Cl.[5] ..... F42B 1/028

[52] U.S. Cl. ..... 102/475; 102/305; 102/473; 102/499; 102/701

[58] Field of Search ..... 102/200, 202, 204, 205, 102/305-310, 318, 322, 332, 283, 285, 286, 470, 473, 475, 476, 481, 499, 500, 701

[56] References Cited

U.S. PATENT DOCUMENTS

| | | | |
|---|---|---|---|
| 2,604,042 | 7/1952 | Cook | 102/701 |
| 2,856,850 | 10/1958 | Church et al. | 102/307 |
| 3,561,361 | 2/1971 | Kessenich et al. | 102/307 |
| 3,658,007 | 4/1972 | Bucklisch | 102/306 |
| 3,802,342 | 4/1974 | Berlot et al. | 102/309 |
| 3,807,309 | 4/1974 | Evans | 102/470 |
| 4,253,523 | 3/1981 | Ibsen | 102/310 |
| 4,901,619 | 2/1990 | Sassmannshausen et al. | 102/306 |
| 5,034,073 | 7/1991 | Barry et al. | 149/19.9 |

*Primary Examiner*—Harold J. Tudor
*Attorney, Agent, or Firm*—John D. Lewis; Roger D. Johnson

[57] ABSTRACT

An explosive device has a main charge explosive, and a booster explosive ring with main charge explosive filling the space in the center of the booster ring. When the booster explosive is set off, explosive shock waves converge on the space in the center of the ring, thus initiating the main charge explosive.

10 Claims, 2 Drawing Sheets

BOOSTER EXPLOSIVE RINGS

BACKGROUND OF THE INVENTION

This invention relates to explosive devices and more particularly to boosters for explosive devices.

To reduce the chance of accidental explosions and fires, the Navy, Air Force, and Army are replacing existing main charge explosives with new, more insensitive explosives such as PBXN-103 and PBXN-109. Additionally, future underwater and bombfill explosives will have critical diameters greater than one inch. Existing booster explosives and fuses have insufficient energy output to reliably initiate the new insensitive main charge explosives. Increasing the amount of booster explosive will increase the weapon's sensitivity and the chance of an accidental detonation. Moreover, the existing Department of Defense (DOD) inventory of fuses and booster explosives is very large and cannot be replaced without considerable cost. What is needed is an inexpensive method of reliably initiating the new, more insensitive main charge explosive while at the same time reducing the chance of the accidental initiation of a fuse booster system.

SUMMARY OF THE INVENTION

Accordingly, an object of this invention is to improve the reliability of operation of fuse/booster explosive initiating systems in explosive devices.

Another object of this invention is to improve the safety of explosive warheads and bombs.

A further object of this invention is to reduce the amount of booster explosive required for explosive warheads and bombs.

Still another object of this invention is to reduce the cost of modifying existing explosive warhead systems with safer, more insensitive main charge explosives.

These and other objects of this invention are achieved by providing:

an explosive device comprising a main charge explosive, a booster explosive in contact with the main charge explosive, and a detonator to set off the booster explosive, wherein the booster explosive is in the form of an annular ring having an outside diameter that is from 0.5 to 1.0 times the critical diameter of the main charge explosive, an inside diameter that is from 0.5 to 0.8 times the outside diameter, and a height that is from 0.5 to 1.0 times the outside diameter, with the space in the center of the ring being filled with main charge explosive.

BRIEF DESCRIPTION OF THE DRAWING FIGURES

A more complete appreciation of this invention and many of the attendant advantages thereof will be readily appreciated as the same becomes better understood by reference to the following detailed description when considered in connection with the accompanying drawings.

Figure 2A:
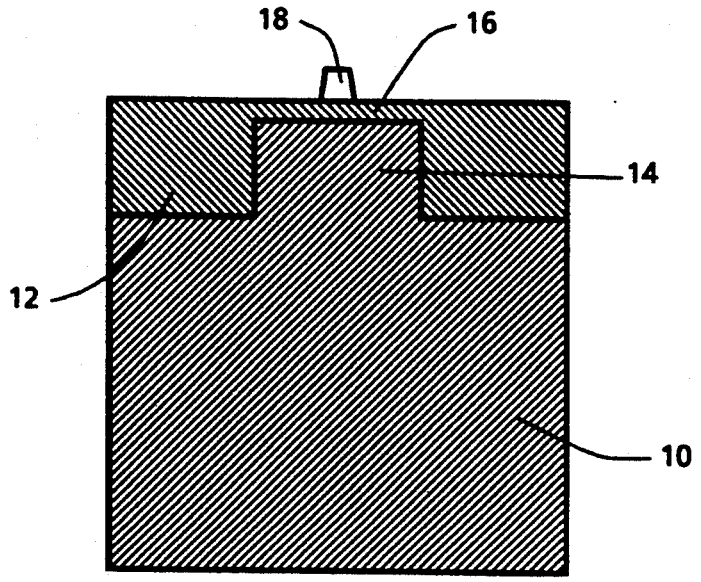
Figure 2B:
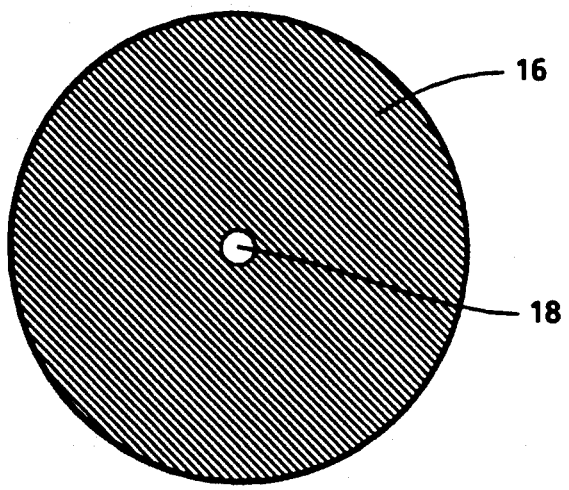

FIG. 2A is a schematic representation of a cross-sectional side view of an explosive device with a booster explosive ring and a thin layer of booster material covering side of the booster explosive ring including the hole in the middle of the ring and having a detonator located at its center; and FIG. 2B is a schematic representation of a top view of the same device showing the thin layer of booster material and the detonator at the center.

FIGS. 1A, 1B, 1C, 2A, and 2B are not drawn to scale.

DETAILED DESCRIPTION OF PREFERRED EMBODIMENT

The present invention provides means for reducing the amount of booster explosive needed to initiate insensitive main charge explosives. For safety, the Navy, Air Force, and Army are replacing present main charge explosives with insensitive main charge explosives having critical diameters greater than 1 inch. The critical diameter for an explosive is the minimum diameter mass of that explosive that can be detonated without being heavily confined. Two examples of these insensitive main charge explosives are PBXW-124 (27% NTO, 20% RDX, 20% aluminum, 20% ammonium perchlorate, and 13% binder by weight) which has a critical diameter of between 3 and 4 inches, and PBXW-122 (47% NTO, 5% RDX, 15% aluminum, 20% ammonium perchlorate, and 13% binder by weight) which has a critical diameter of 7 inches. This invention is preferably used with main charge explosives having a critical diameter greater than 1 inch and more preferably with a critical diameter of from greater that 1 inch up to 7 inches.

Figure 1A:
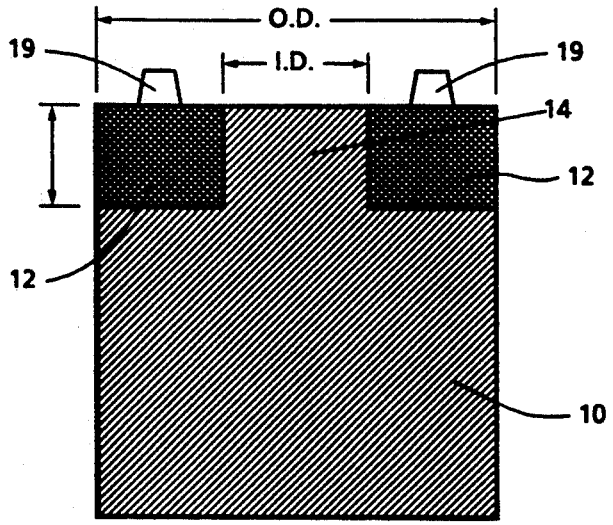
FIG. 1A is a schematic representation of a cross-sectional side view of an explosive device with a booster explosive ring.

Referring to FIG. 1A, there is shown a main charge explosive 10, a booster explosive ring 12, a circular detonator 19 located on the booster explosive ring 12, and a cylinder 14 of main charge explosive which fills the hole in the center of the booster explosive ring 12. The booster explosive ring 12 has a height of H, an outside diameter O.D., and an inside diameter I.D. The cross section of the booster explosive ring 12 is a rectangle. The cylinder 14 of main charge explosive has a height of H and a diameter equal to the inside diameter of the booster explosive ring (I.D.).

Still looking at FIG. 1A, once the main charge explosive 10 is initiated, it is self propagating and all of the main charge explosive 10 reacts. Thus, even though FIG. 1A shows the main charge explosive 10 as a cylinder having the same diameter as the booster explosive ring 12, the main charge explosive 12 may in fact have a much large diameter or may be noncylindrical in shape. Moreover, FIG. 1A is not drawn to scale. The main charge explosive will have a height much greater than is shown. Again, because the main charge explosive 10 is self propagating, it may vary greatly in mass and shape.

Figure 1B:
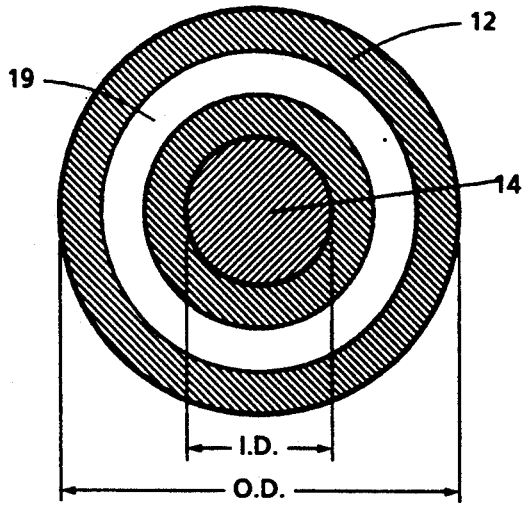
FIG. 1B is a schematic representation of a top view of the same explosive device.

FIG. 1B is a schematic top view of the explosive device (of FIG. 1A) showing the cylinder 14 of main charge explosive filling the hole in the center of the booster explosive ring 12. Also shown is a circular detonator 19.

Figure 1C:
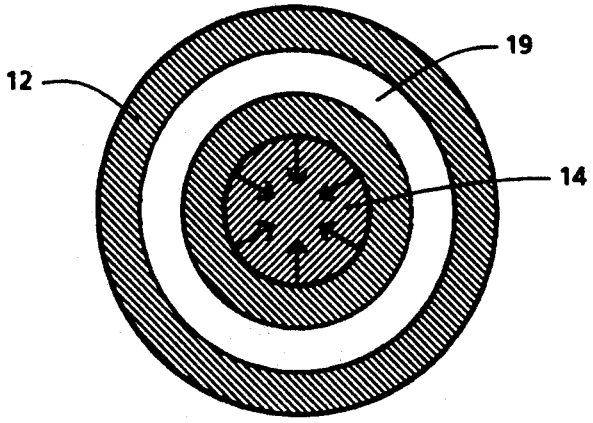
FIG. 1C is schematic representation of the top view of the same explosive device with arrows illustrating how shock waves from the booster explosive ring device converge on the space in the center of the booster explosive ring.

FIG. 1C is the same view as FIG. 1C with arrows added to illustrate the convergence of shock waves into the cylinder 14 of main charge explosive from the explosion of the booster explosive 12.

The outside diameter (O.D.) of the booster explosive ring is preferably from 0.5 to 1.0 times the critical diameter of the main charge explosive. The inside diameter (I.D.) of the booster explosive ring is preferably from 0.5 to 0.8 times the outside diameter. The height (H) of the explosive booster ring is preferably from 0.5 to 1.0 times the outside diameter of the booster ring. Within the range given above, selection of the outside diameter for the booster explosive ring will be influenced by the brisance or power effect of the booster explosive used. The greater the brisance of the booster explosive, the smaller the outside diameter needed for the booster explosive ring.

The cross sections of the rings used in example 2 and shown in FIG. 1A are rectangles. In addition, the cross section may be a conic section such as an ellipse or a parabola to reduce the amount of booster used. Also sections of the booster ring may be removed to reduce the volume of booster explosive. However, this may reduce the booster effectiveness.

A symmetrical detonation of the booster explosive ring is preferred. For the open ring booster explosive charge illustrated by FIGS. 1A and 1B, a circular detonator 19 will be required for a symmetrical detonation. FIG. 2A shows a cross-sectional side and FIG. 2B shows a top view of an explosive device in which the top or outside of the booster explosive ring 12 is covered by a uniform, thin layer 16 of the booster explosive material. By locating a standary detonator 18 at the center of the booster-explosive layer 16, a symmetrical detonation is achieved.

The present invention makes it simple to retrofit existing munitions (bombs, warheads, etc.) with safer explosive fills without having to redesign the existing fuse/booster systems.

The general nature of the invention having been set forth, the following examples are presented as specific illustrations thereof. It will be understood that the invention is not limited to these specific examples, but is susceptible to various modifications that will be recognized by one of ordinary skill in the art.

EXAMPLE 1

Standard Method

A detonator with a cylindrical PBXN-110 high energy explosive booster charge was used to attempt to initiate a PBXW-122 insensitive explosive main charge. The composition of PBXN-110 by weight is 86% cyclotetramethylenetetranitramine (HMX) AND 14% Binder. PBXW-122 has a critical diameter of 7 inches, which means that it cannot be detonated in less than a 7 inch diameter mass unless heavily confined. PBXW-122 has a sensitivity of 130K bars (ELSGT). The composition of PBXW-122 by weight is 47% 3-nitro-1,2,4-triazol-5-one (NTO), 5% cyclotrimethylenetrinitramine (RDX), 20% ammonium perchlorate (AP), 15% aluminum, and 13% binder. A 3 inch high by 5 inch diameter cylindrical charge of PBXN-110 was required to initiate the 65 pounds of PBXW-122 main charge explosive.

EXAMPLE 2

With Booster Explosive Ring

A ring of PBXN-110 having a rectangular cross section, an outside diameter of 4 inches, an inside diameter of 2 inches, and a height of 2 inches was held against 65 pounds of PBX-122 main charge explosive. The space in the center of the ring was filled with a cylinder of PBXW-122 explosive that had a height of 2 inches and a diameter of 2 inches. The PBXN-110 booster explosive ring successfully initiated the PBXW-122 main charge explosive.

In example 1 with a solid cylinder of booster explosive, 235.6 cubic inches of PBXN-110 booster explosive was required to initiate the PBX-122 main charge explosive. However, in Example 2 by using a ring booster explosive configuration only 75.4 cubic inches of PBXN-110 booster explosive was required to initiate the PBXW-122 main charge explosive. Thus, the amount of booster explosive needed was reduced by 68 percent by using a ring booster configuration.

Obviously, numerous modifications and variations of the present invention are possible in light of the foregoing teachings. It is therefore to be understood that within the scope of the appended claims the invention may be practiced otherwise than as specifically described.

I claim:

1. In an explosive device comprising a main charge explosive, a booster explosive in contact with the main charge explosive, and a detonator to set off the booster explosive, the improvement comprising:

the booster explosive being in the form of an annular ring having an outside diameter that is from 0.5 to 1.0 times the critical diameter of the main charge explosive, an inside diameter that is from 0.5 to 0.8 times the outside diameter, and a height that is from 0.5 to 1.0 times the outside diameter, with the booster explosive annual ring having a hole in its center, the hole having a diameter equal to the inside diameter of the ring and a height equal to the height of the ring, the hole being filed with a material consisting essentially of a minor part of the main charge explosive, wherein a major part of the main charge explosive is outside of the hole in the center of the booster explosive ring and is contiguous with the minor part of the main charge explosive that fills the hole in the center of the booster explosive ring.

2. The explosive device of claim 1 wherein the booster explosive ring is embedded in the main charge explosive.

3. The explosive device of claim 1 wherein the booster explosive ring is in contact with a surface of the main explosive charge.

4. The explosive device of claim 1 wherein the cross section of the booster explosive ring is a rectangle.

5. The explosive device of claim 1 wherein the main charge explosive has a critical diameter greater than 1 inch.

6. The explosive device of claim 5 wherein the main charge explosive has a critical diameter of from greater than 1 inch up to seven inches.

7. The explosive device of claim 1 wherein the improvement includes means for symmetrically detonating the annular ring of booster explosive.

8. The explosive device of claim 7 wherein the annular ring of booster explosive is circular and the means for symmetrically detonating it is a circular detonator.

9. The explosive device of claim 7 wherein the annular ring of booster explosive is circular and the means for symmetrically detonating it is a circular thin layer of the booster explosive which covers an outside end of the booster explosive ring including the hole in the center of the ring and a conventional detonator placed at the center of the circular thin layer of booster explosive.

10. The explosive device of claim 9 wherein the cross section of the booster ring is a rectangle.

* * * * *